US008074410B1

(12) United States Patent
Ryba

(10) Patent No.: US 8,074,410 B1
(45) Date of Patent: Dec. 13, 2011

(54) INTERLOCKING MAINFRAME RAIL AND SASH SLOT SYSTEM

(75) Inventor: John Ryba, Hiram, OH (US)

(73) Assignee: Soft-Lite, L.L.C., Streetsboro, OH (US)

( * ) Notice: Subject to any disclaimer, the term of this patent is extended or adjusted under 35 U.S.C. 154(b) by 51 days.

(21) Appl. No.: 11/970,880

(22) Filed: Jan. 8, 2008

Related U.S. Application Data

(60) Provisional application No. 60/883,909, filed on Jan. 8, 2007.

(51) Int. Cl.
*E06B 1/04* (2006.01)

(52) U.S. Cl. ..... 52/211; 52/204.1; 52/204.5; 52/204.55; 52/204.72

(58) Field of Classification Search ..... 52/204.1, 52/204.2, 205–207, 210–217, 204.5–204.72; 49/476.1, 467, 469, 475.1, 483.1, 484.1, 49/61, 62, 63, 125, 404, 411
See application file for complete search history.

(56) References Cited

U.S. PATENT DOCUMENTS

| | | | | | |
|---|---|---|---|---|---|
| 815,941 | A | * | 3/1906 | Dawson | 49/475.1 |
| 1,099,184 | A | | 6/1914 | Leonard | |
| 1,529,093 | A | | 3/1925 | Stewart | |
| 1,547,493 | A | * | 7/1925 | Dunham | 49/423 |
| 1,572,309 | A | | 2/1926 | Rappaport | |
| 1,600,150 | A | * | 9/1926 | Suttle | 49/475.1 |
| 1,619,915 | A | | 3/1927 | Brazell et al. | |
| 2,018,115 | A | * | 10/1935 | Barringer | 49/476.1 |
| 2,120,614 | A | | 6/1938 | Jorss | |
| 2,131,980 | A | | 10/1938 | Sharp | |
| 2,158,298 | A | * | 5/1939 | Oftedal et al. | 49/476.1 |
| 2,889,588 | A | | 6/1959 | Gillespie | |
| 3,271,902 | A | | 9/1966 | Dunsmoor et al. | |
| 3,486,288 | A | * | 12/1969 | Pyne | 52/844 |
| 3,636,660 | A | * | 1/1972 | Peterson | 49/408 |
| 3,956,854 | A | * | 5/1976 | Yamamoto | 49/425 |
| 4,114,233 | A | | 9/1978 | Hamilton | |
| 4,378,659 | A | | 4/1983 | Hosmer et al. | |
| 4,458,739 | A | | 7/1984 | Murray et al. | |
| 4,479,331 | A | * | 10/1984 | Bertolami et al. | 49/404 |
| 4,987,943 | A | | 1/1991 | Charest | |
| D363,794 | S | | 10/1995 | Schrader | |
| 5,488,803 | A | * | 2/1996 | George | 49/425 |
| 5,560,149 | A | * | 10/1996 | Lafevre | 49/501 |
| 5,560,154 | A | * | 10/1996 | Matarazzo | 49/484.1 |
| D381,088 | S | | 7/1997 | DiGiorgio | |
| 6,199,323 | B1 | | 3/2001 | Autovino | |
| 6,223,484 | B1 | * | 5/2001 | Minter | 52/213 |
| 6,311,439 | B1 | * | 11/2001 | Arcati et al. | 52/204.51 |
| D468,455 | S | | 1/2003 | Morton et al. | |
| 6,826,871 | B2 | * | 12/2004 | Morton et al. | 49/504 |
| 2003/0106269 | A1 | * | 6/2003 | Bauman et al. | 49/467 |

* cited by examiner

*Primary Examiner* — Brian Glessner
*Assistant Examiner* — Adam Barlow
(74) *Attorney, Agent, or Firm* — Foley & Lardner LLP

(57) ABSTRACT

The present invention provides an improved interlocking rail and sash slot system that optimizes resistance to sash movement and corresponding air leakage during negative pressure loads, improves energy efficiency and aesthetics of the window design, and provides for wood grain option applications. The improved system may include a window sill and a rail extending from the sill. The rail may include a body portion and a head portion. The head portion may be wider than the body portion in an embodiment. The system may further include a window sash defining a slot. The slot may be configured to receive the head portion. The shape of the head portion of the rail may promote engagement of the head portion with the slot in order to lock the window sill and window sash together when the window is in a closed position.

24 Claims, 1 Drawing Sheet

INTERLOCKING MAINFRAME RAIL AND SASH SLOT SYSTEM

CROSS-REFERENCE TO RELATED APPLICATIONS

This application claims the benefit of U.S. Provisional patent No. 60/883,909 filed Jan. 8, 2007, hereby incorporated by reference in its entirety.

BACKGROUND OF INVENTION a. Field of Invention

The invention relates generally to an interlocking mainframe rail and sash slot system, including an integrated interlocking mainframe rail and sash slot system for double hung windows that may be resistant to negative pressure wind load.

b. Description of Related Art

Conventional systems to achieve high resistance to negative pressure wind load may have a number of deficiencies. For example, in a conventional pocket sill design, a sash may be held structurally in place by sitting in a deep recessed pocket with the sill. The pocket sill design may increase the air infiltration rate of the window because of the requirement to weep water out of the pocket during rain or snow through exterior weep holes connected to the pocket. The pocket sill design may also collect and concentrate dirt in the pocket area, which may be visible when the sash is in the open position. In a conventional sill dam and header sash lift rail interlock, the sash member may be overlapped with sill and header dams. The header dams may be visible and must be machined off before exterior finishes, such as wood grain laminates, may be applied. Accordingly, the removal of the dams in order to finish the exterior of the windows may negate or eliminate the usefulness of the sill dam and header.

Some attempts have been made to utilize flange and groove designs to lock a window sill and sash together. However, these designs are disadvantageous because the flange is completely straight with a constant width along the entire height of the flange. The shape of the straight flange is not conducive to locking the sill and sash in engagement with each other (i.e., locking the straight flange of the sill within the groove of the sash).

Accordingly, there remains a need for system to lock a window mainframe and sash that minimizes and/or eliminates these deficiencies in the prior art.

SUMMARY OF INVENTION

The inventive interlocking mainframe rail and sash slot system for a window may include a window sill and a rail extending from the sill. The rail may include a body portion and a head portion. The head portion may be wider than the body portion in an embodiment. The system may further include a window sash defining a slot. The slot may be configured to receive the head portion. The shape of the head portion of the rail may promote engagement of the head portion with the slot in order to lock the window sill and window sash together when the window is in a closed position.

The invention solves the problems and overcomes the deficiencies of the prior systems for locking a window mainframe and sash. The improved interlocking mainframe rail and sash slot system is advantageous as compared to conventional systems. The improved interlocking mainframe rail and sash slot system may optimize resistance to sash movement and corresponding air leakage during negative pressure loads on double hung windows, thereby improving energy efficiency. The improved system may provide for optimal resistance to sash movement without externally visible hardware which may improve the aesthetics of the overall window design. The improved system may further have a more pleasing aesthetic from an interior view than other systems by also eliminating internally visible hardware. The improved system may also simplify the achievement of higher wind load pressure ratings on double hung window designs. The improved system may eliminate the requirement of a pocket and/or weep system necessary in pocket sill designs, which may result in a better air rating and lower air infiltration rates. The improved system may provide for wood grain option, or other exterior finishing, applications unlike sill dam interlock designs. To the extent that the improved system has hidden areas, wood graining, or other exterior finishing, would not be required.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate an exemplary embodiment of the invention and together with the detailed description serve to explain the principles of the invention. In the drawings.

DETAILED DESCRIPTION OF THE PREFERRED EMBODIMENT

Figure 1:
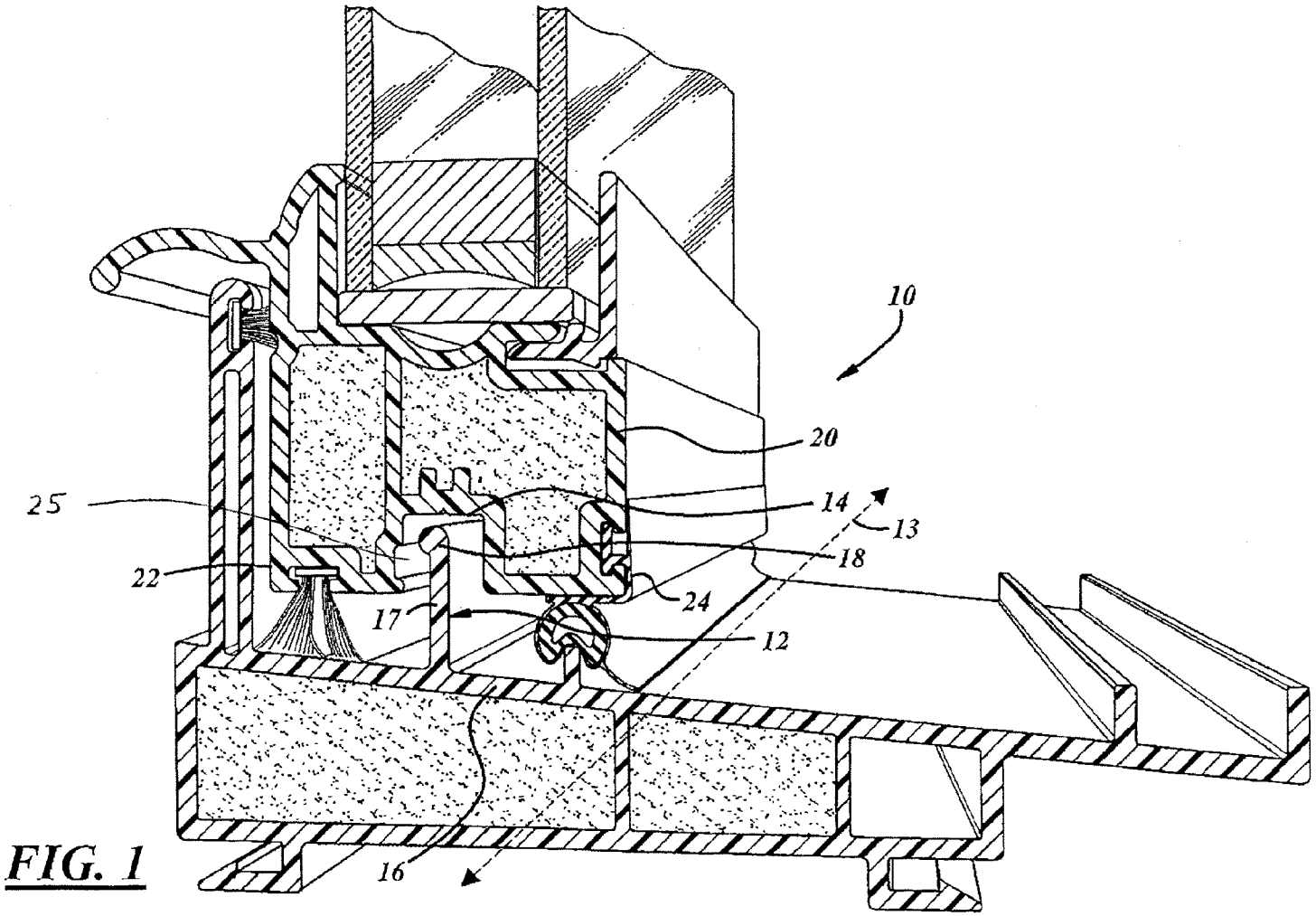
FIG. 1 is a partial, cross-sectional view of an interlocking mainframe rail and sash slot in accordance with the present invention.

Referring now to the drawings wherein like reference numerals designate corresponding parts throughout the several views, FIG. 1 illustrates a cross-sectional view of an interlocking mainframe rail and sash slot system 10 in accordance with the present invention. The system 10 may be utilized in connection with double hung windows, and more particularly, with polyvinyl chloride (PVC) double hung windows. Although these windows are mentioned in detail, it is understood by those of ordinary skill in the art that the inventive system may be used in connection with various types of window designs and remain within the spirit and scope of the invention. The window and associated window components described in the application may be conventional in the art. The interlocking mainframe rail and sash slot system 10 may include rail 12 and slot 14.

Rail 12 is provided as a first member of an interlocking window mainframe and sash system 10. Rail 12 may be a male member disposed on a window sill 16. Rail 12 may comprise extruded polyvinyl chloride (PVC). Rail 12 may extend upwardly from window sill 16 (e.g., a top surface of window sill 16) and may have a length extending along an axis 13 of window sill 16. Rail 12 may have a length that extends along the entire width of window sill 16. In other embodiments, rail 12 may extend less than the entire width of window sill 16.

Rail 12 may include a body portion 17 and a head portion 18. Body portion 17 and head portion 18 may be integral in an embodiment to form a unitary structure. In other embodiments, body portion 17 and head portion 18 may be separate components that are connected together. Both body portion 17 and head portion may be relatively thin in width. At least a portion of head portion 18 may be wider than the body portion 17 of rail 12. The body portion 17 may be about 0.080 inches in width, and the head portion 18 may be about 0.125 inches in width. Although these dimensions are described in detail, the body portion 17 and head portion 18 may be smaller or greater in width in other embodiments.

Head portion 18 may be tear-drop shaped in an embodiment. Head portion 18 may be rounded or have a bulbous shape in other embodiments. Head portion 18 may have a protuberance on a single side of head portion 18 in another embodiment. The shape of head portion 18 may promote a locking engagement between rail 12 and slot 14 when the window is in a closed position. The shape of head portion 18 may improve engagement between rail 12 and slot 14 without adversely affecting and/or obstructing vertical movement of the window sash into various open and closed positions. When the window is in the closed position, rail 12 may engage (e.g., interlock) with a female cavity (i.e., slot 14). In particular, rail 12 may engage with a female cavity (i.e., slot 14) under reverse wind load or negative load. In an embodiment, at least part of body portion 17 and all of head portion 18 of rail 12 may be enveloped by the female cavity. In other embodiments, more or less of rail 12 may be enveloped by the female cavity.

Slot 14 is provided as a second member of an interlocking window mainframe and sash system 10. Slot 14 may comprise a female cavity. Slot (14) includes facing vertical surfaces, one of which may include groove (25). Slot 14 may be extruded with the bottom of a window sash 20. Slot 14 may have a length also extending along axis 13. Slot 14 may have a length that extends along the entire width of window sash 20. In other embodiments, slot 14 may have a length extending less than the entire width of window sash 20. Slot 14 may be located at approximately the midpoint between a first end 22 and second end 24 of window sash 14. Although slot 14 is described as being located at approximately the midpoint between the first end 22 and second end 24 of window sash 20, slot 14 may be located anywhere between the first and second ends 22, 24 of window sash 20 in other embodiments. The window sash 20 may comprise polyvinyl chloride (PVC).

As the window sash 20 is closed to close the window opening, the slot 14 on the window sash 20 envelops rail 12. In an embodiment, all of head portion 18 of rail 12 may be enveloped by slat 14. In an embodiment, at least part of body portion 17 of rail 12 may also be enveloped by slot 14. In other embodiments, more or less of body portion 17 and/or head portion 18 may be enveloped by slot 14. Slot 14 may be about 0.320 inches in width. In an embodiment, head portion 18 of rail 12 may sit into an approximate center of slot 14 when the window sash 20 is closed to close the window opening. Although the head portion 18 of rail 12 is described as sitting in the approximate center of slot 14, head portion 18 of rail 12 may also sit in another location within slot 14 nearer to first or second end 22, 24 of window sash 20. Rail 12, including head portion 18 may sit into window sash 20, and under negative load, the head portion 18 and window sash 20 may engage, thereby strengthening the connection between rail 12 and slot 14 on window sash 20. Rail 12 may then prevent movement of window sash 20 to the exterior during negative pressure wind loads or reverse wind loads, and may therefore, prevent sash weatherstripping from losing contact with interior surfaces of the window. When rail 12 and slot 14 are interlocked, negative pressure wind and structural test and real life wind load pressures may be prevented. The interlock of the window sash 20 profile to the frame (e.g., window sill 16) profile may occur when the negative pressure in the slot 14 may press the rail 12 into the window sash 20 where it may interlock. Slot 14 may have negative pressure, and thus, may create the interlocking of rail 12 and window sash 20.

The inventive interlocking mainframe rail and sash slot system is advantageous as compared to conventional systems for locking a window mainframe and sash. The inventive system optimizes resistance to sash movement and corresponding air leakage during negative pressure loads on double hung windows, without the need for externally visible hardware. The improved system also simplifies the achievement of higher wind load pressure ratings on double hung window designs. The improved system eliminates the requirement of a pocket and/or weep system, which may result in a better air rating. Finally, the improved system provides for wood grain option, or other exterior finish, applications.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. An interlocking frame and sash system for a window, comprising:

a window sill;

a rail extending from and integral with said window sill, said rail including:

a body portion; and a head portion;

wherein said head portion is wider than said body portion and is at least partially rounded in shape; and a window sash defining a slot with facing vertical surfaces, said slot configured to receive said head portion, wherein said head portion of said rail is configured for direct engagement with at least one of said facing vertical surfaces of said slot when said window is in a closed position, wherein said at least one of said facing vertical surfaces includes a groove, wherein said rail is configured to allow for vertical movement of said window sash relative to said window sill when said window is in a closed position and further wherein said rail is configured to interlock said window sill and said window sash when said window is in a closed position, thereby preventing horizontal movement of said window sash, wherein said head portion includes a protuberance on only a single side of said head portion for promoting engagement of said head portion with said slot when said window is in a closed position.

2. A system in accordance with claim 1, wherein said window comprises a double-hung window.

3. A system in accordance with claim 1, wherein said rail extends substantially along an entire width of said window sill.

4. A system in accordance with claim 1, wherein said rail comprises polyvinyl chloride.

5. A system in accordance with claim 1, wherein said body portion and said head portion are integral.

6. A system in accordance with claim 1, wherein said body portion and said head portion are separate components.

7. A system in accordance with claim 1, wherein said body portion is about 0.080 inches in width.

8. A system in accordance with claim 1, wherein said head portion is about 0.125 inches in width.

9. A system in accordance with claim 1, wherein said head portion is tear-drop shaped for promoting engagement of said head portion with said slot when said window is in a closed position.

10. A system in accordance with claim 1, wherein said head portion is rounded or bulbous in shape for promoting engagement of said head portion with said slot when said window is in a closed position.

11. A system in accordance with claim 1, wherein said slot is configured to receive at least part of said body portion.

12. A system in accordance with claim 1, wherein said slot extends substantially along an entire width of said window sash.

13. A system in accordance with claim 1, said window sash including a first end and a second end, wherein said slot is located at about the midpoint between said first end and said second end.

14. A system in accordance with claim 1, wherein said window sill comprises polyvinyl chloride.

15. A system in accordance with claim 1, wherein said window sash comprises polyvinyl chloride.

16. A system in accordance with claim 1, wherein said slot is about 0.320 inches in width.

17. A system in accordance with claim 1, wherein a center of said slot is configured to receive said head portion.

18. A system in accordance with claim 1, wherein said head portion of said rail may be forced into engagement with said at least one of said vertically facing surfaces of said slot of said window sash.

19. A system in accordance with claim 18, wherein a negative pressure load in said slot forces said head portion of said rail into engagement with said at least one of said vertically facing surfaces of said slot of said window sash.

20. A system in accordance with claim 1, wherein the groove is located on said at least one of said vertically facing surfaces of the slot that faces the single protrusion of the head portion.

21. A system in accordance with claim 20, wherein the rail is configured so that the single protrusion is configured to engage with the groove when the window sash is subject to a negative load.

22. An interlocking frame and sash system for a window, comprising:

a window sill;

a rail extending from and integral with said window sill, said rail including:

a body portion; and a head portion;

wherein said head portion is wider than said body portion and is at least partially rounded in shape; and a window sash defining a slot with facing vertical surfaces, said slot configured to receive said head portion, wherein said head portion of said rail is configured for direct engagement with at least one of said facing vertical surfaces of said slot when said window is in a closed position, wherein said at least one of said facing vertical surfaces includes a groove, wherein said rail is configured to allow for vertical movement of said window sash relative to said window sill when said window is in a closed position and further wherein said rail is configured to interlock said window sill and said window sash when said window is in a closed position, thereby preventing horizontal movement of said window sash, wherein said head portion consists of a protuberance on a single side of said head portion that is configured to promote engagement of said head portion with said slot when said window is in a closed position.

23. A system in accordance with claim 1, wherein said at least one of said facing vertical surfaces of said slot includes an upper surface located above the groove and a lower surface located below the groove.

24. A system in accordance with claim 23, wherein said upper and lower surfaces are co-planar.

* * * * *